US006592235B1

(12) United States Patent
Mayo

(10) Patent No.: US 6,592,235 B1
(45) Date of Patent: Jul. 15, 2003

(54) LIGHT EMITTING GLOVE

(76) Inventor: Gary Mayo, 7501 Purdue Ct., Manassas, VA (US) 20109

( * ) Notice: Subject to any disclaimer, the term of this patent is extended or adjusted under 35 U.S.C. 154(b) by 0 days.

(21) Appl. No.: 10/080,442

(22) Filed: Feb. 22, 2002

(51) Int. Cl.[7] ..... F21V 21/08

(52) U.S. Cl. ..... 362/103; 362/205; 362/191; 362/800; 362/184; 2/160

(58) Field of Search ..... 362/103, 800, 362/202, 184, 185, 205; 2/160

(56) References Cited

U.S. PATENT DOCUMENTS 3,638,011 A * 1/1972 Bain et al. ..... 362/103
5,177,467 A * 1/1993 Chung-Piao ..... 340/574
6,006,357 A * 12/1999 Mead ..... 2/160

* cited by examiner

*Primary Examiner*—Sandra O'Shea
*Assistant Examiner*—Ali Alavi

(57) ABSTRACT

Light emitting gloves provide a source of light under poorly lit or dark conditions to facilitate the completion of tasks. Such gloves are particularly useful when the use of both hands is required, eliminating the possibility of one hand holding a light source such as a flashlight. Light emitting gloves are also of great utility when working in a tight area where there may not be room for a separate light source and the hand performing the task. The person wearing the gloves can be seen more clearly from a distance during periods of low visibility, enhancing safety.

19 Claims, 4 Drawing Sheets

LIGHT EMITTING GLOVE

BACKGROUND OF THE INVENTION

1. Field of the Invention

The present invention relates to a light emitting glove for use in connection with performing tasks in poorly lit or dark conditions. The light emitting glove has particular utility in connection with providing hands-free illumination.

2. Description of the Prior Art

Light emitting gloves are desirable for providing a source of light under poorly lit or dark conditions to facilitate the completion of tasks. Such gloves are particularly useful when the use of both hands is required, eliminating the possibility of one hand holding a light source such as a flashlight. Light emitting gloves are also of great utility when working in a tight area where there may not be room for a separate light source and the hand performing the task. An additional benefit is that the person wearing the gloves can be seen more clearly from a distance during periods of low visibility, enhancing safety.

The use of work gloves with illuminator assemblies is known in the prior art. For example, U.S. Pat. No. 3,638,011 to Bain et al. discloses a hand glove and light signal attachment therefor. However, the Bain et al. '011 patent does not allow the user to operate the switch with the hand wearing the glove, and has further drawbacks of providing only one light signal attachment.

U.S. Pat. No. 5,816,676 to Myers et al. discloses a work glove and illuminator assembly that provides a light source for use by health-care professionals when examining or operating upon an anatomical part of a patient. However, the Myers et al. '676 patent does not provide for a plurality of illuminator assemblies, and additionally does not allow the user to operate the switch with the hand wearing the glove.

Similarly, U.S. Pat. No. 5,535,105 to Myers et al. discloses a work glove and illuminator assembly that provides a light source for use by health-care professionals when examining or operating upon an anatomical part of a patient. However, the Myers L. '105 patent does not provide for a plurality of illuminator assemblies, and can not permit the user to operate the switch with the hand wearing the glove.

Furthermore, U.S. Pat. No. 5,345,368 to Huff discloses a hand mounted illuminating device that secures a flashlight to a hand covering portion. However, the Huff '368 patent does not allow the user to turn the flashlight on and off with the hand wearing the hand covering portion, and has the additional deficiency of having a completely removable flashlight, rendering the light source vulnerable to loss.

Additionally, U.S. Pat. No. 4,625,339 to Peters discloses an illuminating glove that mounts a flashlight to a glove. However, the Peters '339 patent does not allow the user to turn the flashlight on and off with the hand wearing the glove, and has the additional deficiency of having a completely removable flashlight, rendering the light source vulnerable to loss.

Lastly, U.S. Pat. No. Des. 423,758 to Jones discloses a glove that covers a user's hand during wear. However, the Jones '758 patent lacks a lighting source.

While the above-described devices fulfill their respective, particular objectives and requirements, the aforementioned patents do not describe a light emitting glove that provides hands-free illumination. The above patents make no provision for turning the light source on and off with the hand wearing the glove. Also, the above patents lack a plurality of light sources.

Therefore, a need exists for a new and improved light emitting glove that can be used for providing hands-free illumination. In this regard, the present invention substantially fulfills this need. In this respect, the light emitting glove according to the present invention substantially departs from the conventional concepts and designs of the prior art, and in doing so provides an apparatus primarily developed for the purpose of providing hands-free illumination.

SUMMARY OF THE INVENTION

In view of the foregoing disadvantages inherent in the known types of work gloves with illuminator assemblies now present in the prior art, the present invention provides an improved light emitting glove, and overcomes the above-mentioned disadvantages and drawbacks of the prior art. As such, the general purpose of the present invention, which will be described subsequently in greater detail, is to provide a new and improved light emitting glove for providing hands-free illumination which has all the advantages of the prior art mentioned heretofore and many novel features that result in a light emitting glove which is not anticipated, rendered obvious, suggested, or even implied by the prior art, either alone or in any combination thereof.

To attain this, the present invention essentially comprises a glove with a light source attached to it and a switch for turning the light source on and off.

There has thus been outlined, rather broadly, the more important features of the invention in order that the detailed description thereof that follows may be better understood and in order that the present contribution to the art may be better appreciated.

The invention may also include additional light sources attached to the glove. The switch may take the form of a pushbutton on/off switch enclosed within the interior of the thumb of the glove. The light source may comprise a light emitting diode inserted into a socket which is further attached to a battery case and enclosed battery via wires. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light emitting glove that has all of the advantages of the prior art work gloves with illuminator assemblies and none of the disadvantages.

It is another object of the present invention to provide a new and improved light emitting glove that may be easily and efficiently manufactured and marketed.

An even further object of the present invention is to provide a new and improved light emitting glove that has a low cost of manufacture with regard to both materials and labor, and which accordingly is then susceptible of low prices of sale to the consuming public, thereby making such light emitting glove economically available to the buying public.

Still another object of the present invention is to provide a new light emitting glove that provides in the apparatuses and methods of the prior art some of the advantages thereof, while simultaneously overcoming some of the disadvantages normally associated therewith.

Even still another object of the present invention is to provide a light-emitting glove for providing hands-free illumination. This allows the user to have one or more light sources at his disposal.

Still yet another object of the present invention is to provide a light-emitting glove for providing hands-free illumination. This makes it possible to have a light source and the use of both hands.

A further object of the present invention is to provide a light-emitting glove for providing hands-free illumination. This enables the user to have a light source in a tight area where a flashlight and a hand would not fit.

A still further object of the present invention is to provide a light-emitting glove for providing hands-free illumination. This makes it possible to be seen easily under low light conditions, thereby enhancing the wearer's safety.

And additional object of the present invention is to provide a light-emitting glove for providing hands-free illumination. This permits the user to turn the light source on and off with the hand wearing the glove.

Lastly, it is an object of the present invention to provide a new and improved light-emitting glove for providing hands-free illumination.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
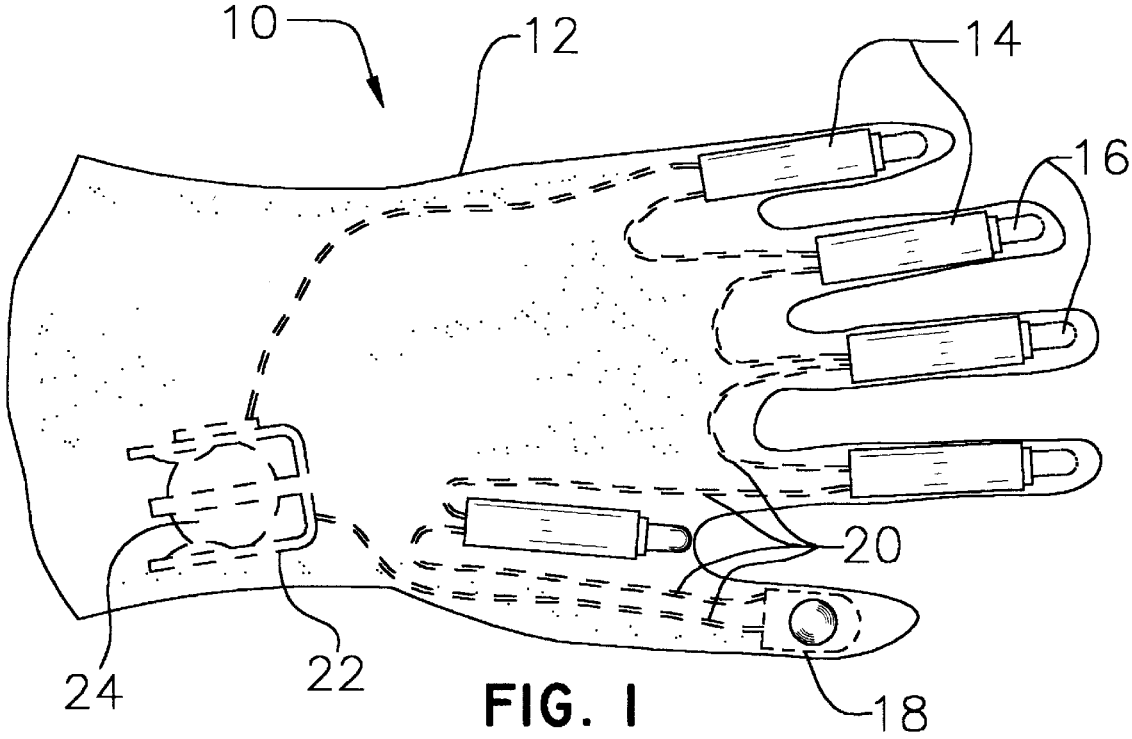
FIG. 1 is a top sectional view of the current embodiment of the light emitting glove constructed in accordance with the principles of the present invention.

Referring now to the drawings, and particularly to FIGS. 1–8, a current embodiment of the light emitting glove of the present invention is shown and generally designated by the reference numeral 10.

In FIG. 1, a new and improved light-emitting glove 10 of the present invention for providing hands-free illumination is illustrated and will be described. More particularly, the light emitting glove 10 has a glove 12 made of vinyl with sockets 14 attached to glove 12 at the top of each finger and between the forefinger and the thumb. Inserted into each socket 14 is a light emitting diode 16. A pushbutton on/off switch 18 is enclosed within the thumb of glove 12. Wires 20 run between each socket 12, the pushbutton on/off switch 18, and battery case 22, thereby connecting them. Enclosed within battery case 22 is battery 24.

Figure 2:
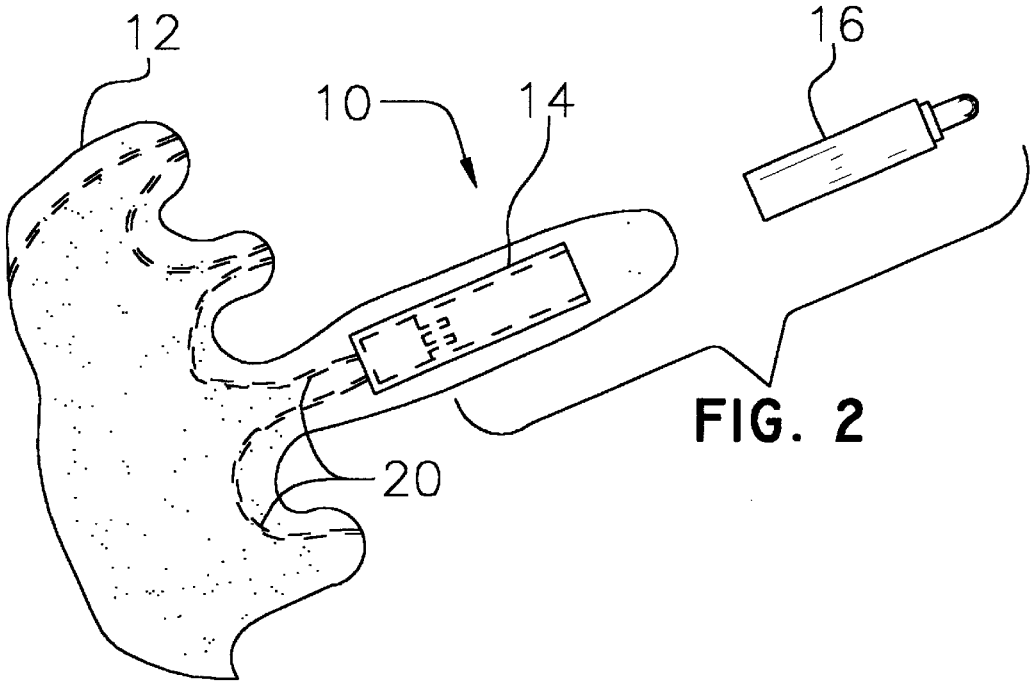
FIG. 2 is a top exploded view of the light-emitting glove of the present invention.

Moving on to FIG. 2, a new and improved light-emitting glove 10 of the present invention for providing hands-free illumination is illustrated and will be described. More particularly, the light emitting glove 10 has a glove 12 upon which is attached socket 14 on the top of a finger of glove 12. As is shown, socket 14 is configured to receive and conduct an electrical current to light emitting diode 16. Wires 20 are also visible.

Figure 3:
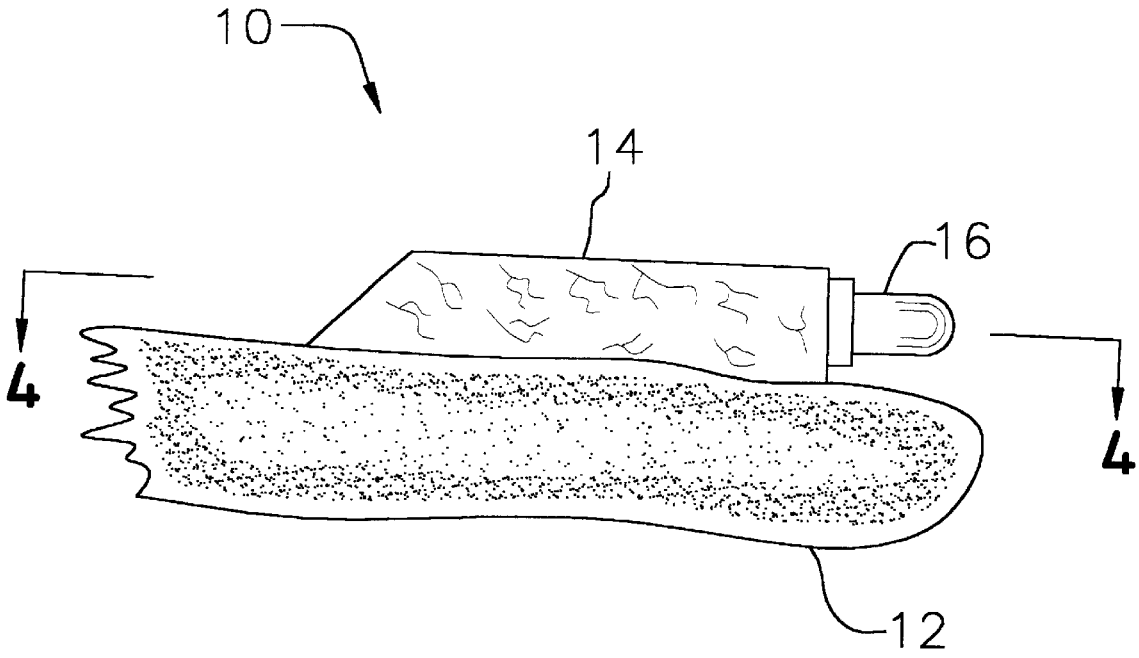
FIG. 3 is a side sectional view of the light-emitting glove of the present invention.

Continuing with FIG. 3, a new and improved light-emitting glove 10 of the present invention for providing hands-free illumination is illustrated and will be described. More particularly, the light emitting glove 10 has a glove 12 with socket 14 attached to the top of a finger of glove 12. Light emitting diode 16 is inserted into socket 14.

Figure 4:
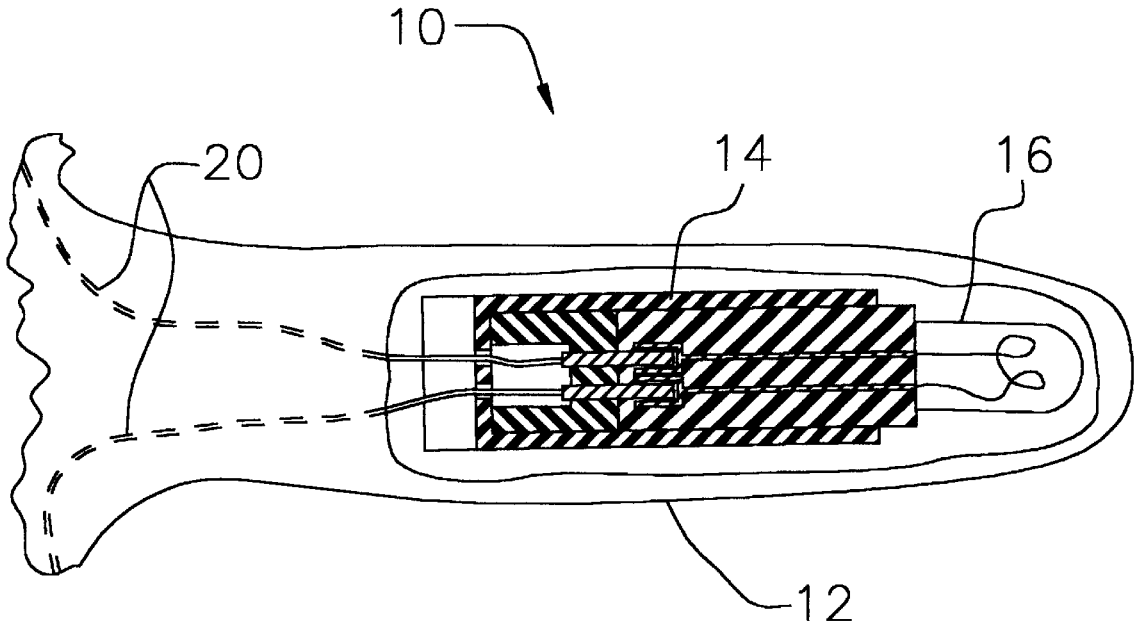
FIG. 4 is a top sectional view of the light-emitting glove of the present invention.

Furthermore, in FIG. 4, a new and improved light-emitting glove 10 of the present invention for providing hands-free illumination is illustrated and will be described. More particularly, the light emitting glove 10 has a glove 12 with socket 14 attached to the top of a finger of glove 12. Details of the socket 14 and how it connects to light emitting diode 16 are shown. Wires 20 are also visible.

Figure 5:
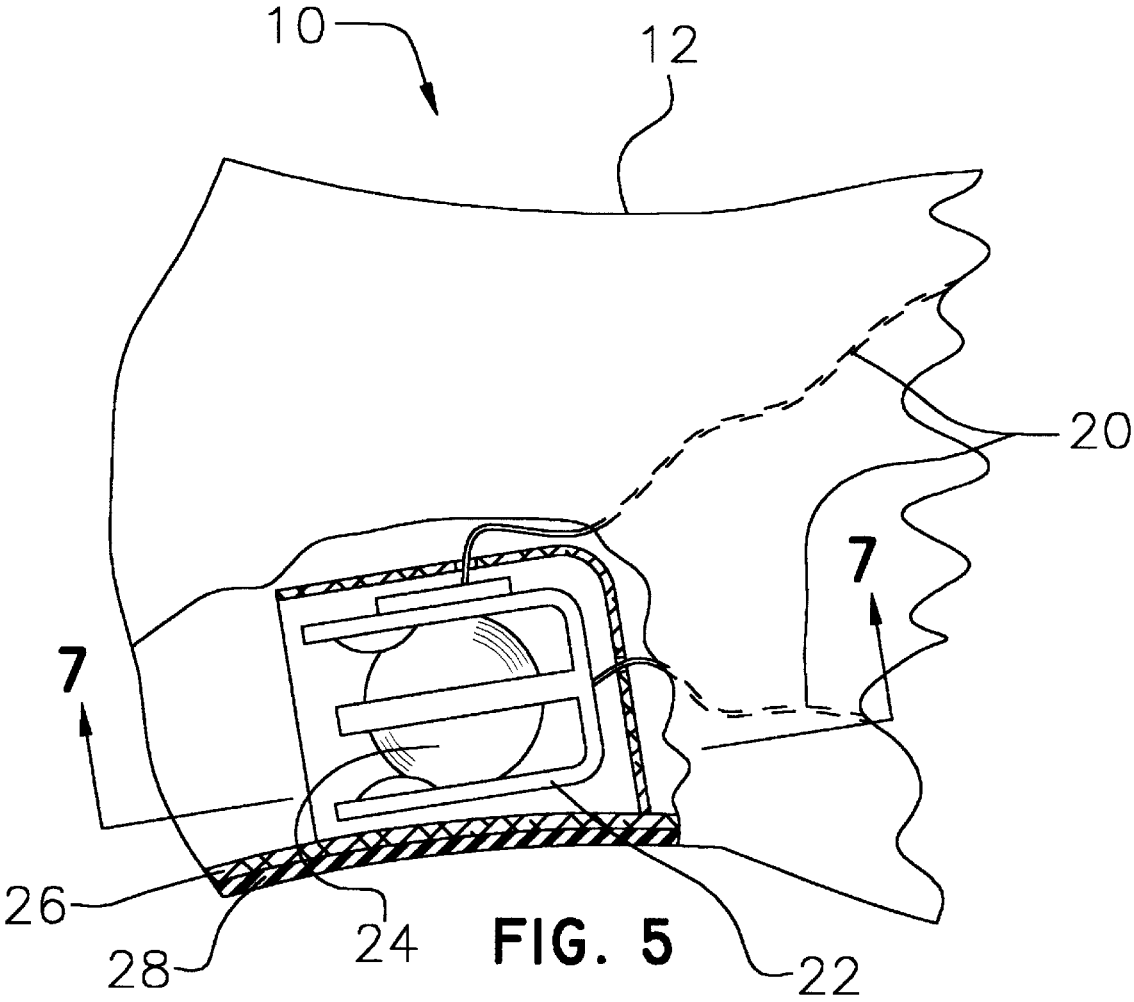
FIG. 5 is a top sectional view of the light-emitting glove of the present invention.

In FIG. 5, a new and improved light-emitting glove 10 of the present invention for providing hands-free illumination is illustrated and will be described. More particularly, the light emitting glove 10 has a glove 12 with an exterior layer 28 made of vinyl and an interior layer 26 made of cloth and laminated to exterior layer 28 visible. Battery case 22 is attached to the interior layer 26 of glove 12. Battery 24 is enclosed within battery case 22. Wires 20 are also visible.

Figure 6:
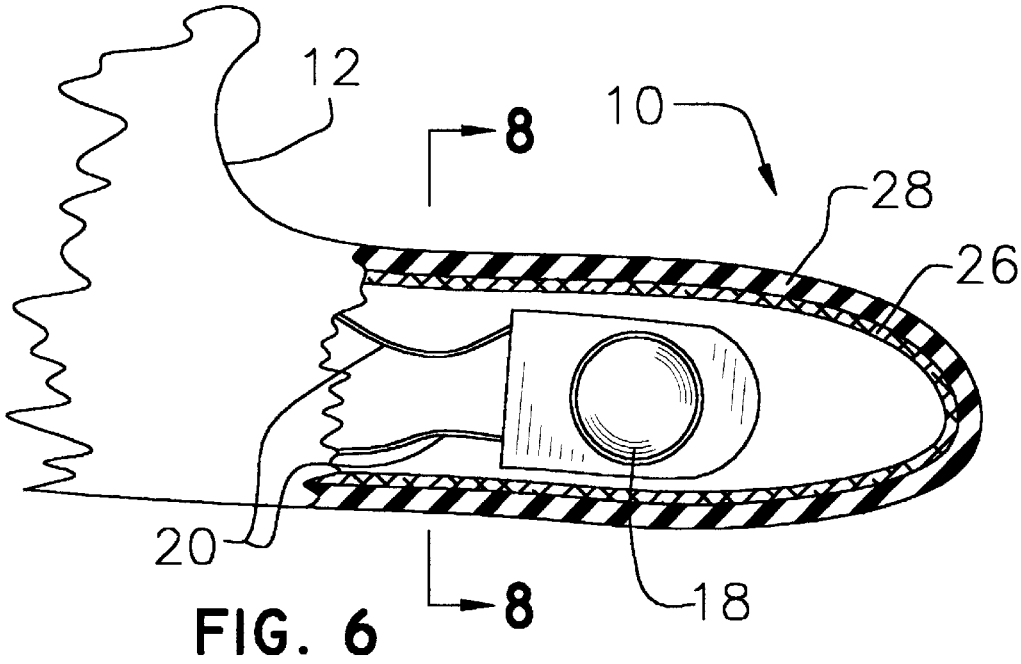
FIG. 6 is a top sectional view of the light-emitting glove of the present invention.

Moving on to FIG. 6, a new and improved light-emitting glove 10 of the present invention for providing hands-free illumination is illustrated and will be described. More particularly, the light-emitting glove 10 has a glove 12 with exterior layer 28 and interior layer 26 visible. Contained within the thumb of glove 12 is pushbutton on/off switch 18 with connected wires 20.

Figure 7:
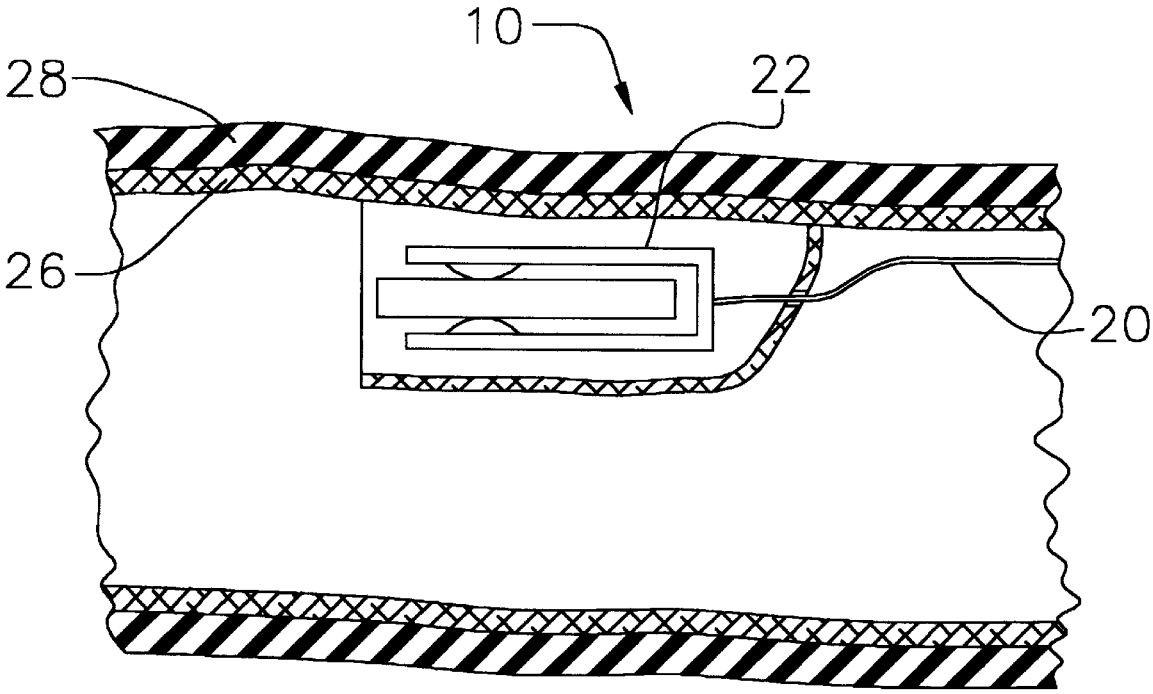
FIG. 7 is a side sectional view of the light-emitting glove of the present invention.

Continuing with FIG. 7, a new and improved light-emitting glove 10 of the present invention for providing hands-free illumination is illustrated and will be described. More particularly, the light-emitting glove 10 has a glove 12 with exterior layer 28 and interior layer 26 visible. Battery case 22 is attached to the interior layer 26 of glove 12. Battery 24 is enclosed within battery case 22. A wire 20 is also visible.

Figure 8:
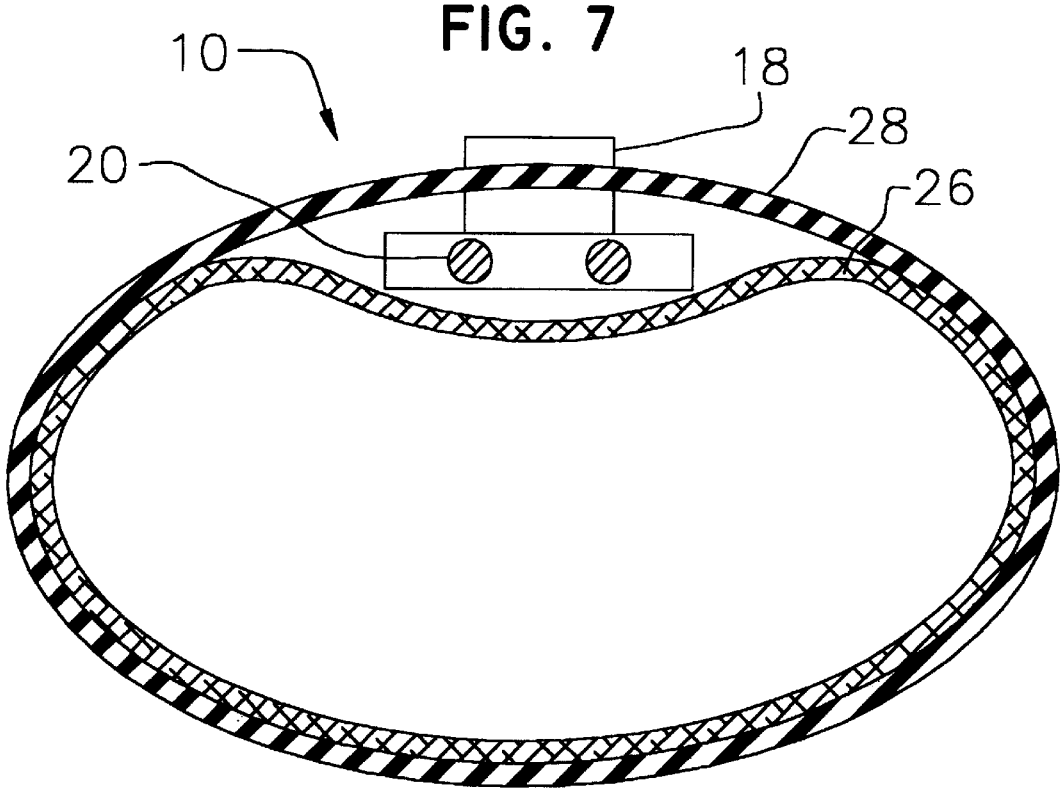
FIG. 8 is a rear sectional view of the light-emitting glove of the present invention.

Lastly, in FIG. 8, a new and improved light-emitting glove 10 of the present invention for providing hands-free illumination is illustrated and will be described. More particularly, the light emitting glove 10 has a glove 12 with exterior layer 28 and interior layer 26 visible. Pushbutton on/off switch 18 is enclosed within the thumb of glove 12. Wires 20 are also visible.

While a current embodiment of the light-emitting glove has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy and flexible material such rubber, leather, or cloth may be used instead of the vinyl described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light emitting glove comprising:

a glove having an interior surface and an exterior surface;

a light source attached to said glove; and a switch attached to said interior surface of said glove.

2. The light emitting glove as defined in claim 1, wherein said glove comprises:

an exterior layer; and an interior layer laminated to said exterior layer.

3. The light emitting glove as defined in claim 2, wherein said exterior layer is selected from the group consisting of leather, cloth, rubber, and vinyl.

4. The light emitting glove as defined in claim 2, wherein said interior layer is selected from the group consisting of leather, cloth, rubber, and vinyl.

5. The light emitting glove as defined in claim 1, wherein said light source comprises:

a light emitting diode;

a socket attached to said exterior surface of said glove enclosing said light emitting diode; and a power source attached to said socket.

6. The power source as defined in claim 5, wherein said power source comprises:

a battery case;

a battery enclosed within said battery case;

a first wire having opposing ends with one end connected to said battery and said opposing end connected to said socket;

a second wire having opposing ends with one end connected to said socket and said opposing end connected to said switch; and a third wire having opposing ends with one end connected to said switch and said opposing end connected to said battery.

7. The switch as defined in claim 2, wherein said switch comprises a pushbutton on/off switch.

8. A light emitting glove comprising:

a glove having an interior, an interior surface, an exterior surface, four fingers, and a thumb;

a switch mounted on said interior surface of said thumb of said glove so as to protrude into said interior of said glove;

a second wire having opposing ends with one end connected to said switch; and a light source connected to said opposing end of said second wire.

9. The light emitting glove as defined in claim 8, wherein said glove comprises:

an exterior layer; and an interior layer laminated to said exterior layer.

10. The light emitting glove as defined in claim 9, wherein said exterior layer is selected from the group consisting of leather, cloth, rubber, and vinyl.

11. The light emitting glove as defined in claim 9, wherein said interior layer is selected from the group consisting of leather, cloth, rubber, and vinyl.

12. The light emitting glove as defined in claim 8, wherein said light source comprises:

a light emitting diode;

a socket enclosing said light emitting diode;

a first wire having opposing ends with one end connected to said socket; and a power source attached to said opposing end of said first wire.

13. The light emitting glove as defined in claim 12, wherein said power source comprises:

a battery case;

a battery enclosed within said battery case; and a third wire having opposing ends with one end connected to said battery case and said opposing end connected to said switch.

14. The switch as defined in claim 8, wherein said switch comprises a pushbutton on/off switch.

15. In combination with a glove, including an interior surface, an exterior surface, four fingers, and a thumb, the improvement which comprises:

a plurality of light sources attached to said exterior surface of said fingers;

a plurality of socket wires having opposing ends with said opposing ends connecting said plurality of light sources to one another a second wire having opposing ends with one end connected to at least one of said light sources;

a switch connected to said opposing end of said second wire and mounted on said interior surface of said thumb;

a first wire having opposing ends with one end connected to at least one of said light sources;

a power source connected to said opposing end of said first wire; and a third wire having opposing ends with one end connected to said power source and said opposing end connected to said switch.

16. The improvement to a glove as defined in claim 15, wherein said light source comprises:

a light emitting diode; and a socket enclosing said light emitting diode.

17. The improvement to a glove as defined in claim 15, wherein said power source comprises:

a battery case; and a battery enclosed within said battery case.

18. The improvement to a glove as defined in claim 15, wherein said switch is of the pushbutton on/off type.

19. The improvement to a glove as defined in claim 15, wherein said power source is attached to said glove.

* * * * *